United States Patent [19]

Bittar et al.

[11] Patent Number: 4,792,019

[45] Date of Patent: Dec. 20, 1988

[54] CONTIGUOUS FLOOR CHANNELING WITH UP HALL CALL ELEVATOR DISPATCHING

[75] Inventors: Joseph Bittar; Kandasamy Thangavelu, both of Avon, Conn.

[73] Assignee: Otis Elevator Company, Farmington, Conn.

[21] Appl. No.: 157,543

[22] Filed: Feb. 12, 1988

[51] Int. Cl.[4] ..... B66B 1/20

[52] U.S. Cl. ..... 187/125; 187/128

[58] Field of Search ..... 187/124, 125, 127, 128

[56] References Cited

U.S. PATENT DOCUMENTS

| | | | |
|---|---|---|---|
| 2,688,383 | 9/1954 | Eames | 187/128 |
| 3,857,465 | 12/1974 | Iwasaka et al. | 187/128 |
| 4,007,812 | 2/1977 | Nelson, Jr. | 187/128 |
| 4,401,190 | 8/1983 | Bittar | 187/127 |
| 4,463,834 | 8/1984 | Polis et al. | 187/127 |
| 4,691,808 | 9/1987 | Nowak et al. | 187/125 |

*Primary Examiner*—William M. Shoop, Jr.
*Assistant Examiner*—W. E. Duncanson, Jr.

[57] ABSTRACT

An elevator system contains a group of elevator cars. A group controller contains signal processing means for controlling the dispatching of the cars from a main floor or lobby in relation to differnt group parameters. During up-peak conditions, each car is dispatched from the main floor to an individual plurality of contiguous floors, defining a "sector". Sectors are contiguous. The number of sectors may be less than the number of cars. Floors that constitute a sector are assigned exclusively to a car and are displayed on an indicator at the lobby. Sectors are selected for assignment according to preset order (e.g. numerical). Cars are selected for assignment to a selected sector according to a preset order (e.g. numerical). If no car calls are made to the floors in the sector that is assigned to a car, the next sector is selected along with the next car according to that order. When an up hall call is made during the up-peak period, the car that is most able to serve the call is selected if it is assigned to a sector in the upper $\frac{2}{3}$ of the building. Cars are evaluated for the assignment from the most favorable to the least favorable until the most favorable car serving a sector in the upper $\frac{2}{3}$ of the building is found. Cars serving floors in the lower $\frac{1}{3}$ of the building are never assigned to up hall calls during the up-peak period.

3 Claims, 4 Drawing Sheets

CONTIGUOUS FLOOR CHANNELING WITH UP HALL CALL ELEVATOR DISPATCHING

RELATED APPLICATIONS

This specification describes apparatus also disclosed in U.S. patent application Ser. No. 157,542 by Thangavelu, et al titled "Contiguous Floor Elevator Dispatching" filed Feb. 12, 1988.

TECHNICAL FIELD

This invention pertains to dispatching elevator cars in an elevator system containing a plurality of cars providing group service to a plurality of floors in a building during up-peak conditions and to dispatching cars to answer hall calls for interfloor traffic during up-peak conditions.

BACKGROUND ART

In a building having a group of elevators, elevator interfloor traffic and traffic from the lobby or main floor (e.g. lobby) to upper floors varies throughout the day. Traffic demand from the main lobby is manifested by the floor destinations entered by passengers (car calls) on the car call buttons. Traffic the lobby is usually highest in the morning in an building. This is known as the "up-peak" period, the time of day when passengers entering the building at the lobby mostly go to certain floors and when there is little if any "interfloor" traffic (few hall calls). Within the up-peak period, traffic demand from the lobby may be time related. Groups of workers for the same business occupying adjacent floors may have the same starting time but different from other workers in the building. A large influx of workers may congregate in the lobby awaiting elevator service to a few adjacent or contiguous floors. Some time later, a new influx of people will enter the lobby to go to different floors.

During an up-peak period, elevator cars that are at the lobby frequently do not have adequate capacity to handle the traffic volume (the number of passengers) to the floors to which they will travel. Some other cars may depart the lobby with less than their maximum (full) loads. Under these conditions, car availability, capacity and destinations are not efficiently matched to the immediate needs of the passengers. The time it takes for a car to r®turn to the lobby and pick up more passengers (passenger waiting time) expands when these loading disparities are present.

In the vast majority of group control elevator systems in use, waiting time expansion is traceable to the condition that the elevator cars respond to car calls from the lobby without regard to the actual number of passengers in the lobby that intend to go to the destination floor. Two cars can serve the same floor, separated only by some dispatching interval (the time allowed to elapse before car is dispatched) Dispatching this way does not minimize the waiting time in the lobby because the car load factor (the ratio of actual car load to its maximum load) is not maximized and the number of stops made before the car returns to lobby to receive more passengers is not minimized.

In some existing systems, for instance U.S. Pat. No. 4,305,479 to Bittar et al on "Variable Up-Peak Elevator Dispatching", assigned to Otis Elevator Company, the dispatching interval from the lobby is regulated. Sometimes, this means that a car, in a temporary dormant condition, may have to wait for other cars to be dispatched from the lobby before receiving passengers who then enter car calls of the car.

To increase the passenger handling capacity per unit of time, the number of stops that a car can make may be limited to certain floors. Cars, often arranged in banks, may form a small group of cars that together serve only certain floors. A passenger enters any one of the cars and is permitted to enter a car call (e.g., pressing a button on the car operating panel) only to the floors served by the group of cars. "Grouping", as this is commonly called, increases car loading, improving system efficiency, but does not minimize round trip time back to the lobby. The main reason is that it does not force the car to service the lowest possible floor with the minimum number of stops before reaching that floor.

In some elevators, cars are assigned floors based on car calls that are entered from a central location. U.S. Pat. No. 4,691,808 to Nowak et al on "Adaptive Assignment of Elevator Car Calls", assigned to Otis Elevator Company, describes a system in which that takes place, as does Australian patent No. 255,218 granted in 1961 to Leo Port. This approach directs the passengers to cars.

DISCLOSURE OF THE INVENTION

According to the invention, in a building having a plurality (X) of contiguous floors above or below a main floor, for instance the floors above a lobby, during the "up-peak period" the dispatching sequence follows a scheme by which the floors are arranged in N contiguous sectors (N being an integer less than X). N or more cars are used to serve the sectors, but each sector is assigned (served) at any one time by only one of the cars. The floors in the sector assigned to (served by) a car are displayed on a indicator to the lobby. Once a car responds to the car calls for floors in the sector it is typically returned to the lobby for assignment once again to a sector. Selection of a sector for assignment is made according to a preset sequence, as is the selection of the next car for assignment. Cars are selected by that sequence as they approach a committable position for stopping at the lobby and when they are at the lobby. According to one aspect of the invention, sectors and cars are selected according to numerical order, in effect a "round-robin" selection. If car calls are not made to floors in the sector after the car doors are closed, the doors then reopen and the car is again assigned to next sector that is selected according to the numerical sequence. The floors in the sector are assigned to the car—only as long as the assignment exists. Additionally according to the invention, down hall calls (interfloor traffic) are assigned to cars that are at or the hall call and free to pick up additional call assignments (as they return to the lobby from the sector). Up hall calls, on the other hand, are assigned based upon the location of the hall call in the building, the car calls made to each car at the lobby when it is being dispatched from the lobby to its exclusive sector, from which it would normally return in the absence of hall calls and a car ability—relative to other cars—to answer the up hall call. When there is a coincident call for a car and an up hall call, the car answers the call. If the up hall call is not coincident with a car call, the car assigned to the hall call will be that car that would normally be assigned to the hall call under a non up-peak condition provided that the car is assigned to serve a sector in an "upper" portion of the building (for example in the upper ⅔) and that sector either the sector that contains the hall call or is a sector above that sector. If, however, the up hall call is in the remaining (lower) portion of the building, the hall call is assigned to the next car that is dispatched from the main floor to just those sectors above the lower portion This restriction means that cars serving those sectors in the lower portion cannot answer the up hall call, unless it is coincident with a car call. In effect, cars with the longest round trip time to their assigned sector answer hall calls by going up. Hence, the overall percentage increase in round trip time from the main floor to all the floors in the group is minimized when answering up hall calls.

BEST MODE FOR CARRYING OUT THE INVENTION

Figure 1:
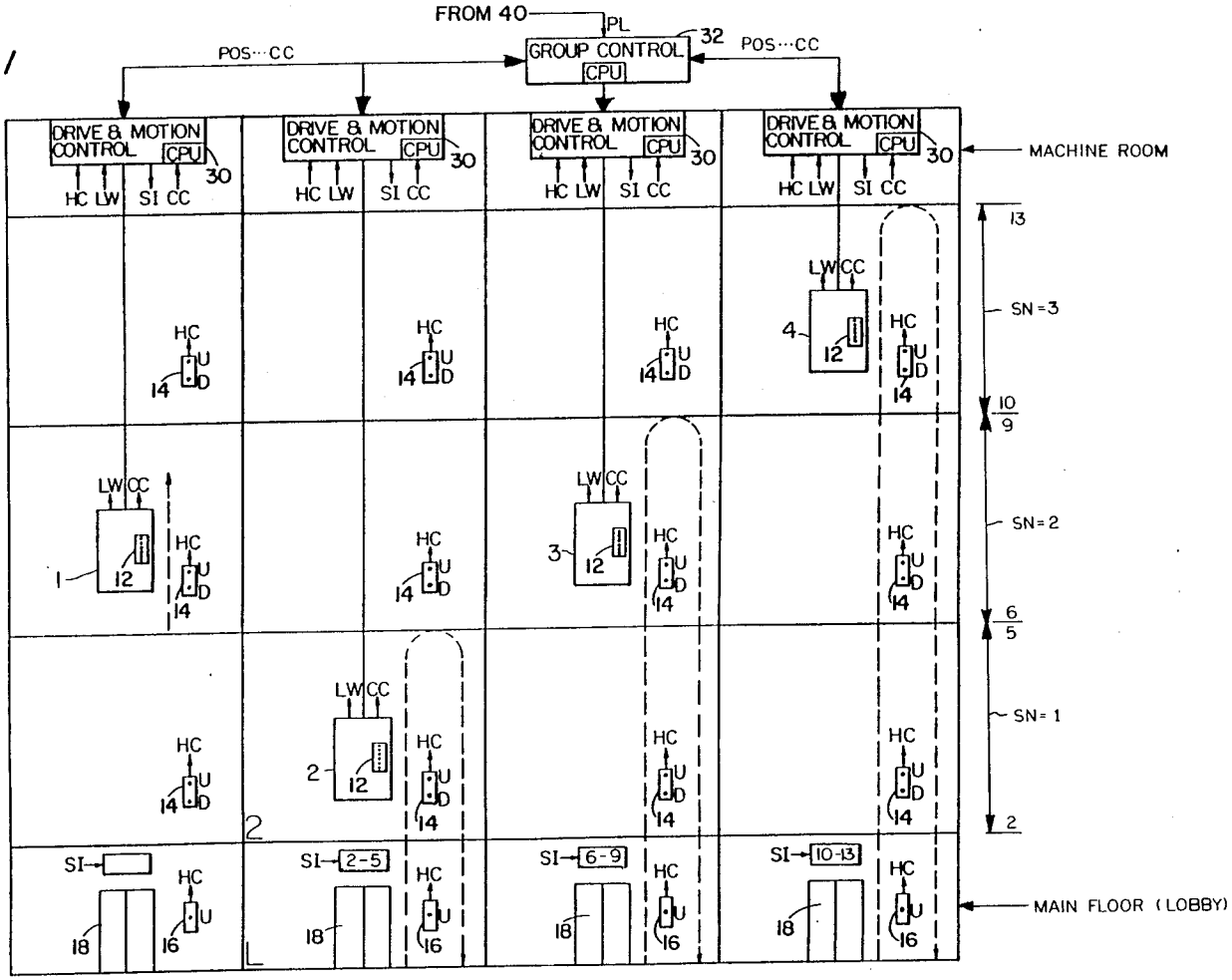
FIG. 1 functional block diagram of an elevator system consisting of a four car "group" serving thirteen floors.

In FIG. 1, four elevator cars 1–4, which are part of a group elevator system, serve a building having a plurality of floors. For the purpose of this discussion, the building has thirteen floors above a lobby. Each car 1–4 contains a car operating panel 12 through which a passenger makes a car call to a floor by pressing a button, producing a signal CC, identifying the floor to which the passenger intends to travel. On each of the floors here is a hall fixture 14 through which a hall call signal HC is provided to indicate the intended direction of travel by a passenger on the floor. At the lobby L, there is also a hall call fixture 16, through which a passenger calls the car to the lobby. The depiction of the group in FIG. 1 is intended to illustrate the selection of cars during an up-peak period according to the invention at which time the floors 2–13, above the main floor, are divided into three sectors, each containing four floors. The floors in the building are divided into three sectors SN, each containing four floors. Each of the sectors, which are contiguous, are served by only one of the four cars 1–4 at any time, an operation explained in more detail below in context with the flow charts forming FIG. 2A–2B and leaving one car free, which is contemplated to be the preferred application of the invention. However, the building may be divided into four sectors, in which case all the cars can be used to serve the sectors.

At the lobby, and located above each door 18, there is a service indicator SI for a car, which shows the temporary selection of floors exclusively reachable from the lobby by a car based on the sector assigned to the car. That assignment changes throughout the up-peak period, as explained below, where it is also said that each sector is given a number SN and each car is given a number CN. In the case of car 2, CN=2, it is assigned to serve the sector 1, SN=1. Car 3, CN=3, serves the sector 2, SN=2. Car 4, CN=4, serves sector 3, SN=3. Car 1, CN=1, is momentarily not assigned to a sector. The service indicator SI for car 2 disllays floors 2–5, the floors in secoor 1, to which that car exclusively provides service from the lobby—but for one trip from the lobby. Car 3 similarly provides exclusive service to sector 2 consisting of floors 6–9, and the indicator for car 3 shows those floors. The indicator for car 4 indicates floors 10–13, the floors in sector 3. The service indicator for the car 1 is not illuminated, showing that it is not serving any sector at this particular instant of time during the up-peak, channeling sequence reflected in FIG. 1. Car 1, however, may have one of the sectors assigned to it ss it approaches the lobby at a subseqeent time, depending on the position of the other cars at that time and the current assignment of sectors to cars. As explained below, the assignment of sectors to cars follows a sequence that follows the numerical order of the cars and sectors, as a result of which, sectors are assigned and cars are selected for assignment as they reach the committable position for the lobby in a cyclical pattern, producing a "round-robin" assignment over time.

Each car 1–4 will only respond to car calls that are made in the car from the lobby to floors that coincide with the floors in the sector assigned totthe car. The car 4, for instance, will only respond to car calls made at the lobby to floors 10–13. It will take passengers from the lobby to those floors (provided car calls are made to those floors) and then return to the lobby empty, unless it is assigned, using the sequences described below, to answer an up or down hall call that has been made on one of the floors. When that happens, the car will not be assigned to a sector until it returns to the lobby. As noted, this mode of dispatching is used during an up-peak period. At other times of the day (when there is more "interfloor" traffic) different dispatching routines may be used to satisfy interfloor traffic and traffic to the lobby (it tends to build after the up-peak period, which occurs at the beginning of the work day). For example, the dispatching routines shown in these U.S. patents (the "Bittar patents", all assigned to Otis Elevator Company) may be used at other times in whole or in part in an overall dispatching system in which the routines associated with the invention are accessed during the up-peak condition: U.S. Pat. No. 4,363,381 to Bittar on "Relative System Response Call Assignments", U.S. Pat. No. 4,323,142 to Bittar et al on "Dynamically Reevaluated Elevator Call Assignments".

As in other elevator systems, each car 1–4 is connected to a drive and motion control 30. Each of these motion controls 30 is connected toaa grou control 32. Although it is not shown, each car's position in the building would be served by the conrroller through a position indicator as shown in the previous patent to Bittar et al. The controls 30,32 contain a CPU (central processing unit or signal processor) for processing data from the system. A group controller 32 that, using signals from the drive and motion controls 30, sets the sectors that will be served by each of the cars. Each motion control 30 receives the HC and CC signals and provides a drive signal to the service indicator SI. Each motion control also receives data from the car that it controls on the car load LW. It also measures the lapsed time while the doors are open at the lobby (the "dwell time", as it is commonly called). The drive and motion controls are shown in a very simplified manner herein because numerous patents and technical publications showing details of drive and motion controls for elvators are available. It i assumed therefore that the CPUs in the controllers 30,32 are programmable to carry out the routine described herein to effect the dispatching operation of this invention at a certain time of day or under seletted building conditions, and it is also assumed that at other times the controllers are capable of resorting to a different dispatching routine, for instance, the routines shown in the aforementioned Bittar patents.

Owing to the computing capability of the CPUs, this system can collect data on individual and group demands throughout the day to arrive at a historical record of traffic demands for each day of the week and compare it to actual demand to adjust the overalldispatching sequences to achieve a prescribed level of system and individual car performance. Following such an approach, car loading and lobby traffic may also be analyzed through signals LW, from each car, that indicates the car load. Actual lobby traffic may also be sensed by using a people sensor (not shown) in the lobby. U.S. Pat. No. 4,330,836 to Donofrio et al on an "Elevator Cab Load Measuring System" and U.S. Pat. No. 4,303,851 to Mottier on a "People and Object Counting System", both assigned to Otis Elevator Company, show approaches that may be employed to generate those signals. Using such data and correlating it with th time of day and the day of the week and the actual entry of car calls and hall calls, a meaningful demand demograph can be obtained for allocating the sectors throughout the up-peak period in accordance with the invention by using a signal processing routine that implements the sequences described on the flow chart comprising FIGS. 2A–B in order to minimize the waiting time from the lobby.

Figure 2A:
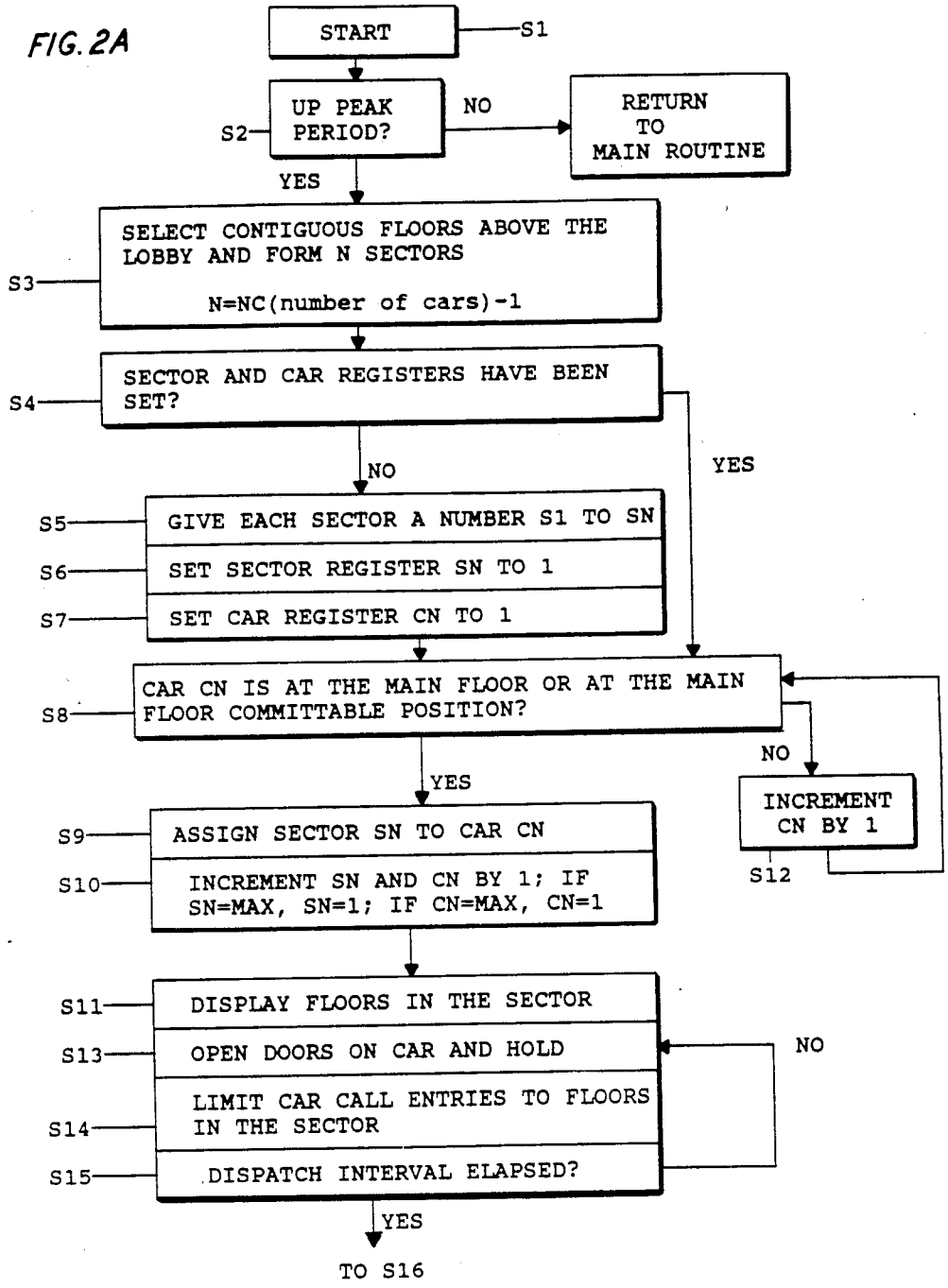
FIG. 2 is a flow chart that shows a dispatching routine according to the present invention.
Figure 2B:
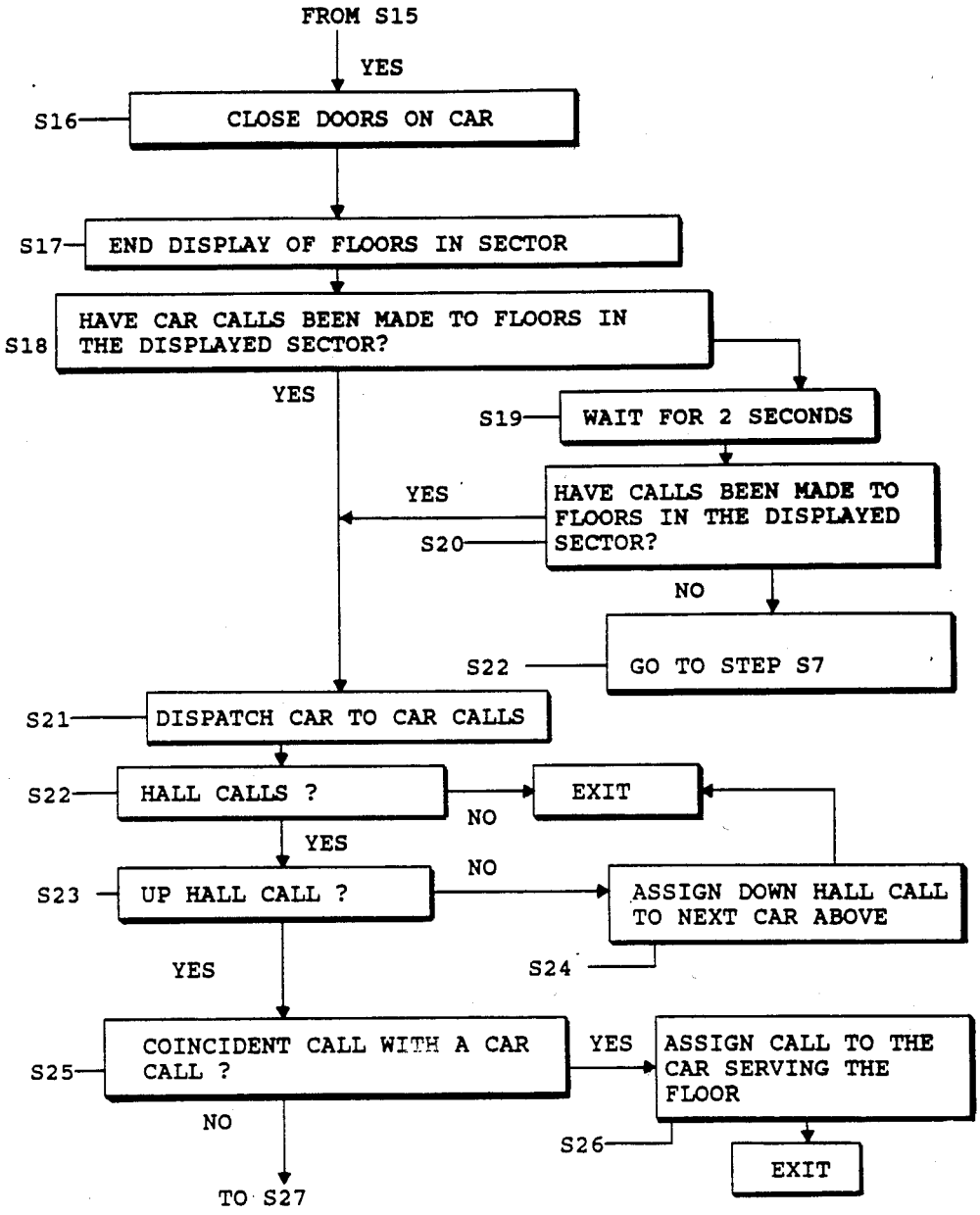

In discussing hte dispatching of cars to sectors using the assignment scheme or logic illutstated in FIGS. 2A–B, it is assumed (for convenience) thea the elevator cars 1–4 are moving throughout the building, eventually returning to the lobby (main floor serving upper floors) to pick up passengers. According to FIGS. 2A–B, which shows a flow chart for controlling the assignment of sectors and the dispatching of cars according to the present invention on a rapidly occurring cyclical basis, this "up-peak" channeling dispatching routine begins at step S1 then at step S2 a test is made to determine whether an up-peak condition exists, for instance, it is the morning on a business day. If the answer to step S2 is in the negative (no), the subroutine exit from the channeling routine to a main elevator control dispatching routine such as what is shown in the previously mentioned Bittar patents. If the answer to step S2 is in the affirmative (yes), step S3 proceeds in which the secotrs are formed of contiguous floors above the lobby. In step S3, the number of sectors is "N", which is equal to the number of cars (NC) minus one. For instance, in FIG. 1 there are three sectors and four cars. As noted previously, the number of sectors can equal number of cars, but having more cars than sectors reduces t he internal between cars that successively serue the same sector. Hall call assignments may be made according to the description below.

In step S4, a test is made that determines if the up-peak channeling routine has been previously entered, which could have resulted in the performance of step S5, in which each sector is given a number (an integer), and in the performance of step S6, in which a sector register, in the group control, is set to 1, presumably the lowest SN, and in the performance of step S7, in which a similar car register is set to the lowest CN, presumably 1. For the purposes of illustration, in FIG. 1, the sector serving floors 2–5 has an SN of 1, the sector serving floors 6–9 has an SN of 2 and the sector serving floors 10–13 has an SN of 3. Car 1 would have a CN of 1, car C2 a CN of 2, car C3 a CN of 3 and car C4 a CN of 4. CN and SN can be assumed to be initialized at one. The sequences illustrated by the flow chart attempt to assign a sector to car 1, starting with sector 1. In the preferred embodiment, one using a modern CPU, the selection process takes place many times per second.

If the answer at S4 is affirmative, step S8 is entered. Step S8 is also entered after the registers are initialized. In step S8, the test is whethrr the car with the number (CN) then under consideration is at the committable position, a position at which the car is ready to initiate stopping at the lobby. If the answer to this test is negative (in FIG. 1 it would be negative because car 1 is moving away), CN is increased by one unit in step S12, meaning that the assignment attempt now shifts to car 2. For the purpose of illustration, assume that car 2 is descending at the indicated position. This will yield an affirmative answer at S8, causing assignment of the sector 1 (containing floors 2–5) to car 2, that taking place in step S9. In step S10 both SN and CN are incremented by one, but SN or CN have reached their respetive maximum, something that would happen after each car and each sector is assigned. When that happens, SN and CN are set to one once again (on nn individual basis). This sequence of operations has the effect of causing the sectors to be assigned to the cars in a numerically cycling pattern.

In step Sll, the floors in the sector assigned to a car in the previous sequence are displayed on the lobby or main floor on the "service indicator" SI. Step S13 commands the opening of the car doors when the car reaches the lobby and hllding the doors in the open position to receive passengers, who presumably enter the car intending to enter car calls on the car call buttons (on the car operating panel) to go to the floors appearing on the service indicator. Car calls only to those floors are limited by step S14. In step S15, it is determined if the dispatching interval has elapsed. If not (a negative answer) therroutine cycles back to S13, keeping the doors open. Once the dispatching interval passes (producing an affirmative answer at S15), the doors are closed at step S16. The service indicator is then deactivated at step S17 (until the next sector is assigned to the car). Step S18 determines if "permissible" car calls (car calls to floors in the sector) have been made. Since a sector is assigned to a car without regard to the entry of car calls, there is no demand for the sector at the particular time that the car is at the lobby ready to receive passengers (when the sector is assigned to the car at the main floor or lobby). Hence, if permissible car calls have not been made, the routine goes through step S19, where it waits for a short interval (e.g. 2 seconds) and repeats the test of S18 (at step S20). If the answer is still negative, the routine moves back to step S8 on the instruction at step S22. The routine the considers the assignment of the next numerical sector to the next numerical car at the committable position. Since a numerical sequenee is followed, conflicts between cars at the committable position at the same time does not encumber the assignment process.

The size of the sector is fixed in the foregoing description, but the invention may be applied to a system in a way that adjusts the size of the sectors. The size may be changed based on actual or anticipated traffic patterns in the building. For instance, the number of floors in a sector may be enlarged sothat each sector has roughly equal passenger load from the lobby or within floor. The number of floors in the sectors does not have to be same, although that has been shown, but only for convenience in explaining the invention. Changes in sector size can be made based on measured passenger density in the lobby and correlating it with expected car call requests at the particular time that the assignment of sectors are made in a subroutine cycle. The previous sector will be assigned again in another cycletto another car, by which time the car call requests may materialize allowing the car to be dispatched to the requested floors.

Following step S21, in which a car is dispatched to he car calls made for the car to floors in the sector to which the car is assigned, the routine moves on to consider up and down hall calls (signals HC in FIG. 1), which are requests for service made at one of the floors. These reqeests give rise to interfloor traffic, which is usually light during the up-peak period. Consequently assignment of hall calls is given a Comparatively low priority when the up-peak channeling routine is in effect. Hall call assignments, at that time, are made in a way that brings cars back to the lobby as fast a possible for assignment to a sector, to minimize waiting time. In step S22, a simple test is made that finds if any hall calls have been made during the assignment cycle. If not, the routine is exited. If a hall call has been made on a floor, step S23 finds if it is a request to go down (down hall call) or up in the building. If it is a down hall call, in step S24, the hall call will be answered by the next available car traveling down from a location ator above the location of the hall call. Presumably, that assignment can be made according to the normal criteria, for instance, using the techniques described in the Bittar patents for selecting a car for hall call assignment on a comparative basis. If it is found that there is an up hall call, step S25 finds if there is a coiniident car call in one of the cars at the lobby (assigned to a sector). If the answer is yes, the up hall call will be assigned to that car.

Figure 2C:
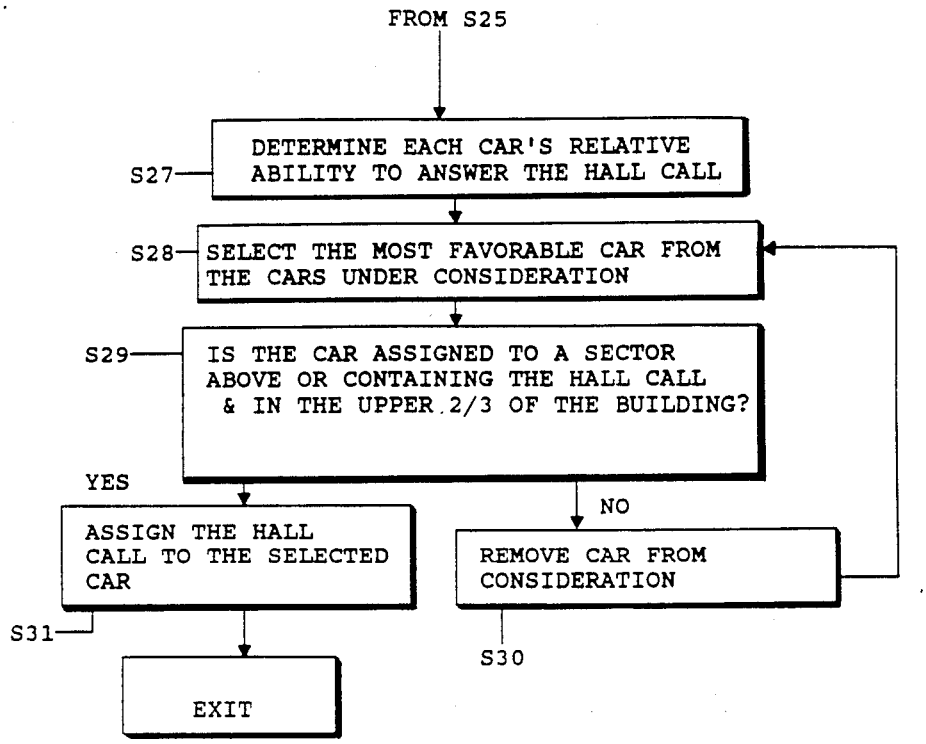

If the the answer at S25 is negative, step S27 determines each car's ability to answer the up hall call under traditional criteria, preferably using sequences described in the previous patents to Bittar et al, by which a car is selected from all the other cars for final assignment by considering the impact of the assignment on overall system response. The sequences in FIGS. 2A–C overlays on to the "normal selection" scheme an additional standard that enhances the up-peak channeling discussed before. At step S28, the sequence selects, using a normal selection routine, the most favorable car to answer the hall call and tests, at step S29, if the car is serving a sector in the upper $\frac{2}{3}$ of the building and if that sector is the sector that contains the floor on which the hall call was made or is a higher sector (i.e., above the sector containing the floor on which the hall call is placed). If the most favorable car can not meet that test, using step S34, which increments the selection to the next most favorable car, the program cycles through from the most favorable to the least favorable until an affirmative answer is obtained to step S32, causing the assignment of the up hall call to the car meeting the test, this taking place in step S33.

While the foregoing is a description of the best mode for carrying out the invention and also describes variations and modifications that may be made to the invention in whole or in part, it will be understood by one skilled in the art that other modifications and variations may be made to the apparatus and the programs described herein without departing from the true scope and spirit of the invention.

We claim:

1. An elevator comprising a plurality of cars for transporting passengers from a main floor to a plurality of contiguous floors above or below the main floor; car call means for entering car calls for each car; indicating means at the main floor for indicating the intended floor stops for a car; car motion control means for moving each car; car position means for providing a position signal indicating the location of the car; door control means for controlling the opening and closing of the doors on each car; and a controller for providing signals that control the operation of the motion control, the door control means and the indicating means in response to the position signal and car calls, characterized in that:

said controller comprises signal processing means providing signals:

for dividing the floors in the building into a plurality of sectors less than or equal to the plurality of cars, eah sector comprising one or more contiguous floors, the sectors being contiguous with each other;

for assigning a sector exclusively to one of the cars during a cycle of a cyclical assignment sequence that assigns a sector exclusively to one car during one cycle according to a preset sector order and a preset car order as a car approaches a particular position relative to the main floor for receiving passengers at the main floor;

for allowing a car to move away from the main floor in response to car calls only if the car calls are to floors in the sector assigned to the car;

for indicating on the indicating means the floors in a sector assigned to a car;

for assigning a different sector to said one car if car calls meeting preset criteria are not made to floors in the sector after the sector is assigned to the car;

for assigning an up hall call to a car having a coincident car call from the main floor;

for assigning an up hall call made in a lower portion of the building and not coincident with a car call made at the main floor only to a car dispatched to or about to be dispatched to a sector in the remaining portion of the building;

for assigning to a car an up hall call in said remaining portion of the building and not coincident with a car call made at the main floor, said car being selected on the criterion that the car has been or is about to be dispatched to the sector containing the floor on which the up hall has been made or to a sector above said sector; and for selecting said car from all other cars meeting said criterion on the basis that relative to said other cars the car would be assigned to the up hall call if none of said other cars were assigned to sectors.

2. A method for dispatching elevators from the main floor to floors above or below the main floor in a building in response to car calls made at the main floor and in response to the location of the cars, characterized by:

dividing the floors in the building into a plurality of sectors less than or equal to the plurality of cars, each sector comprising one or more contiguous floors, the sectors being contiguous with each other;

assigning a sector exclusively to one of the cars during a cycle of a cyclical assignment sequenee that assigns sectors according to a preset sector order and a preset car order as a car approaches a particularpposition relative to the main floor;

allowing a car to move aaay from the main floor in response to car calls only if the car calls are to floors in the sector assigned to the car;

indicating at the main floor the floors in a sector assigned to a car;

assigning a different sector to said one car if car calls meeting preset criteria are not made to floors in the sector after the sector is assigned to the car;

assigning an up hall call to a car having a coincident car call from the main floor;

assigning an up hall call made in a lower portion of the building and not coincident with a car call made at the lobby only to a car dispatched to or about to be dispatched to a sector in the remaining portion of the building;

assigning an up hall call in said remaining portion of the building and not coincident with a car call made at the main floor to a car selected on the criterion that the car has been or is about to be dispatched to the settor containing the floor on which the up hall has been made or to a sector above said sector; and for selecting said car from all other cars meeting said criteria on the basis that relative to said other cars the car would be assigned to the up hall call if none of said other cars were assigned to sectors.

3. An elevator controller for controlling the assignment of car calls among a plurality of elevator cars serving a plurality of floors in a building in response to car calls made at a main floor to floors above or below the main floor, for controlling the operation of th doors on each car and for controlling an indicator at the main floor that is capable of indicating the floors to which each car may travel, characterized by signal processing means for providing signals:

for dividing the floors in the building into a plurality of sectors less than or equal to the plurality of cars, each sector comprising one or more contiguous floors, the sectors being contiguous with each other;

for assigning a sector exclusively to nne of the cars by following a cyclical assignment sequence that assigns sectors according to a preset sector order and a preset car order as a car approaches a particular position relative to the main floor;

for allowing a car to move away from the main floor in response to car callsoonly if the car calls are to floors in the sector assigned to the car;

for indicating on the indicating means the floors in a sector assigned to a car;

for assigning a different sector to said one car if car calls meeting preset criteria are not made to floors in the sector after the sector is assigned to the car;

for opening and closing the doors on a car to which a sector is sssigned to receive passengers from the main floor;

for assigning an up hall call to a car having a coincident car call from the main floor;

for assigning an up hall call made in a lower portion of the building and not coincident with a car call made at the lobby only to a car dispatched to or aoout to be dispatched to a sector in the remaining portion of the building;

for assigning an up hall call in said remaining portion of the building and not coincident with a car call made at the main floor to a car selected on the criterion that the car has been or is about to dispatched to the sector containing the floor on which the up hall has been made or to a sector above said sector; and for selecting said car from all other cars meeting said criterion on the basis that relative to said other cars the car would be assigned to the up hall call if none of said other cars were assigned to sectors.

* * * * *

UNITED STATES PATENT AND TRADEMARK OFFICE

CERTIFICATE OF CORRECTION

PATENT NO. : 4,792,019

DATED : December 20, 1988

INVENTOR(S) : Joseph Bittar et al

It is certified that error appears in the above-identified patent and that said Letters Patent is hereby corrected as shown below:

Col. 1, line 25, after "Traffic" insert --from--

Col. 1, line 26, after "an" insert --office--

Col. 1, line 47, "r®turn" should be --return--

Col. 2, line 2, "of" should be --for--

Col. 2, line 36, "to" should be --at--

Col. 2, line 53, after "or" insert --above--

Col. 3, line 1, after "that sector" insert --is--

Col. 3, line 16, after "FIG. 1" insert --is a--

Col. 3, line 19, after "FIG. 2" insert --A-C--

Col. 3, line 32, "here" should be --there--

Col. 3, line 62, "disllays" should be --displays--

Col. 3, line 63, "secoor" should be --sector--

Col. 4, line 5, "ss" should be --as--

Col. 4, line 6, "subseqeent" should be --subsequent--

Col. 4, line 17, "totthe" should be --to the--

Col. 4, line 39, delete "et al"

Col. 4, line 43, "toaa grou" should be --to a group--

Col. 4, line 45, "conrroller" should be --controller--

Col. 4, line 65, "seletted" should be --selected--

UNITED STATES PATENT AND TRADEMARK OFFICE

CERTIFICATE OF CORRECTION

PATENT NO. : 4,792,019

DATED : December 20, 1988

INVENTOR(S) : Joseph Bittar et al

It is certified that error appears in the above-identified patent and that said Letters Patent is hereby corrected as shown below:

Col. 5, line 26, "hte" should be --the--

Col. 5, line 27, "illutstated" should be --illustrated--

Col. 5, line 28, "thea" should be --that--

Col. 5, line 44, "secotrs" should be --sectors--

Col. 5, line 49, after "equal" insert --the--

Col. 5, line 51, "serue" should be --serve--

Col. 6, line 28, "hllding" should be --holding--

Col. 6, line 51, "routine the" should be --routine then--

Col. 6, line 54, "sequenee" should be --sequence--

Col. 6, line 63, "within" should be --main--

Col. 7, line 3, "cycletto" should be --cycle to--

Col. 7, line 7, "he" should be --the--

Col. 7, line 12, "reqeests" should be --requests--

Col. 7, line 25, "ator" should be --at or--

Col. 7, line 31, "coiniident" should be --coincident--

In claim 1, col. 8, line 16, "eah" should be --each--

In claim 2, col. 8, line 62, "sequenee" should be --sequence--

In claim 2, col. 8, line 66, "aaay" should be --away--

UNITED STATES PATENT AND TRADEMARK OFFICE

CERTIFICATE OF CORRECTION

PATENT NO. : 4,792,019

DATED : December 20, 1988

INVENTOR(S) : Joseph Bittar et al

It is certified that error appears in the above-identified patent and that said Letters Patent is hereby corrected as shown below:

In claim 2, col. 9, line 18, "settor" should be --sector--

In claim 3, col. 10, line 9, "callsoonly" should be --calls only--

In claim 3, col. 10, line 24, "aoout" should be --about--

Signed and Sealed this

Twelfth Day of December, 1989

*Attest:*

JEFFREY M. SAMUELS

*Attesting Officer*

*Acting Commissioner of Patents and Trademarks*